US006591440B2

(12) United States Patent
Stegens et al.

(10) Patent No.: US 6,591,440 B2
(45) Date of Patent: Jul. 15, 2003

(54) BRUSHROLL WITH ROTATABLY MOUNTED END ASSEMBLY

(75) Inventors: Alfred H. Stegens, Olmsted Township, OH (US); Eric A. Stegens, Olmsted Falls, OH (US)

(73) Assignee: The Scott Fetzer Company, Westlake, OH (US)

( * ) Notice: Subject to any disclaimer, the term of this patent is extended or adjusted under 35 U.S.C. 154(b) by 8 days.

(21) Appl. No.: 09/974,354

(22) Filed: Oct. 10, 2001

(65) Prior Publication Data

US 2003/0066149 A1 Apr. 10, 2003

(51) Int. Cl.[7] ..... A46B 13/02
(52) U.S. Cl. ..... 15/179; 15/383
(58) Field of Search ..... 15/179, 181–183, 15/366, 383, 389, 391, 392

(56) References Cited

U.S. PATENT DOCUMENTS

| | | | |
|---|---|---|---|
| 1,559,830 A | | 11/1925 | Woodall |
| 1,999,696 A | | 4/1935 | Kitto |
| 2,372,404 A | | 3/1945 | Taylor |
| 3,225,374 A | * | 12/1965 | Daley et al. |
| 4,361,929 A | * | 12/1982 | Jinkins |
| 4,912,805 A | | 4/1990 | Krasznai et al. |
| 5,003,663 A | | 4/1991 | Sunagawa et al. |
| 5,193,243 A | | 3/1993 | Stegens |
| 5,249,328 A | * | 10/1993 | Shin |
| 5,272,785 A | | 12/1993 | Stegens |
| 5,373,603 A | | 12/1994 | Stegens |
| 5,435,038 A | | 7/1995 | Sauers |
| 5,452,490 A | | 9/1995 | Brundula et al. |
| 5,465,451 A | | 11/1995 | Stegens |
| 5,495,634 A | | 3/1996 | Brundula et al. |
| 5,598,600 A | | 2/1997 | Stegens |
| 6,003,198 A | | 12/1999 | Stegens |
| 6,148,475 A | | 11/2000 | Stross |

FOREIGN PATENT DOCUMENTS

| | | |
|---|---|---|
| DE | 3039167 | 5/1982 |
| GB | 2628 | 3/1898 |
| GB | 2086717 | 5/1982 |
| IT | 671202 | 10/1964 |

* cited by examiner

*Primary Examiner*—Terrence R. Till
(74) *Attorney, Agent, or Firm*—Watts, Hoffmann, Fisher & Heinke, Co., L.P.A.

(57) ABSTRACT

A vacuum cleaner brushroll having skirted, one piece plastic ferrules inserted into the ends of a tufted, wood spindle so that the ferrule skirts embrace the spindle end portions to prevent the ferrules from loosening upon expansion of the spindle due to moisture. The skirts are drilled to permit angled tufting to be inserted very near the spindle ends with the tufting extending axially and radially outwardly beyond the spindle ends to provide improved edge cleaning and create a wider cleaning path compared to conventional brushroll designs.

9 Claims, 2 Drawing Sheets

BRUSHROLL WITH ROTATABLY MOUNTED END ASSEMBLY

TECHNICAL FIELD

The present invention relates generally to vacuum cleaners, and more specifically to the end assemblies that rotatably mount a brushroll in a vacuum cleaner.

BACKGROUND ART

An example of brushroll mounting assemblies is disclosed in U.S. Pat. No. 5,272,785 dated Dec. 18, 1993, the disclosure of which is incorporated herein by reference. The disclosed mounting assemblies include stub shafts which are fixed in the ends of the spindle, bearings which have their inner races pressed fitted on the projecting ends of the stub shafts, and outer end members, e.g. end caps, that receive the outer races of the bearings and serve as a means for mounting the brushroll in the mouth of the vacuum cleaner nozzle.

Certain prior art brushrolls include metal ferrules that embrace the outer ends of the spindle. In a typical construction, the stub shafts extend through center openings of the ferrules into the spindle ends. The metal ferrules can have expanded end openings that receive projecting portions of the end caps in order to guard against threads and dirt from entering the bearings.

SUMMARY OF THE INVENTION

The present invention features a skirted, one piece plastic ferrule that fits into each end of the spindle and receives the stub shaft of the end assembly. The one-piece ferrule includes a peripheral skirt that embraces the end portion of the spindle, a hollow pin which is pressed into the end of the spindle and receives the stub shaft, and a web connecting the pin and skirt.

In a disclosed embodiment, each end of the spindle has a hole in which the ferrule pin is pressed, a countersunk mouth, and an outer, axially extending lip around the mouth of the hole. The ferrule web has a radial bottom wall confronting the bottom of the spindle mouth, an axial wall fitted against the inside of the spindle lip, and a second radial wall that connects the skirt and axial wall. The skirt and axial wall of the ferrule are radially spaced apart to define an annular recess or cavity that receives the spindle lip.

The described ferrule of the invention provides a number of important advantages. The plastic skirts around the end portions of the spindle can be drilled with a conventional wood drill to provide tuft holes very near the ends of the spindle. The skirt prevents cracking or splitting of the spindle ends when they are drilled. Angled tufts extend through the skirts beyond the ends of the spindle in order to widen the normal brush cleaning path. The angled tufts at the ends of the spindle improve edge cleaning and overall cleaning characteristics of the brushroll. The metal ferrules of the prior art cannot be drilled with conventional wood drills to permit tufting at the ends of the spindle. Thus, a brushroll with metal ferrules at its ends necessarily has a narrower cleaning path than achieved with the ferrule of the present invention.

Moisture changes in wooden spindles can cause shrinking and swelling of the wood. In many conventional constructions, swelling can result in the pins or stub shafts which mount the bearings from loosening in the holes of the spindle, thereby causing brushroll rattle and general unsatisfactory operation. The skirted ferrule of the present invention avoids this difficulty. As the spindle swells against the ferrule skirt, the wood is compressed to maintain a firm grip on the ferrule pin. Metal ferrules address the same problem, but, as described above cannot achieve the same wide cleaning path and edge cleaning capability that characterize the present invention.

Another feature of the invention is that it creates a lower cost product compared to the metal ferrule and multi-part constructions of the prior art. The ferrule including the hollow pin, skirt and connecting web can be injection molded as a one piece part that is easily assembled with the spindle.

Still other features, advantages and a fuller understanding of the invention will become apparent to those skilled in the art from the following description of the preferred embodiment of the invention and the accompanying drawings.

DESCRIPTION OF PREFERRED EMBODIMENT

Figure 1:
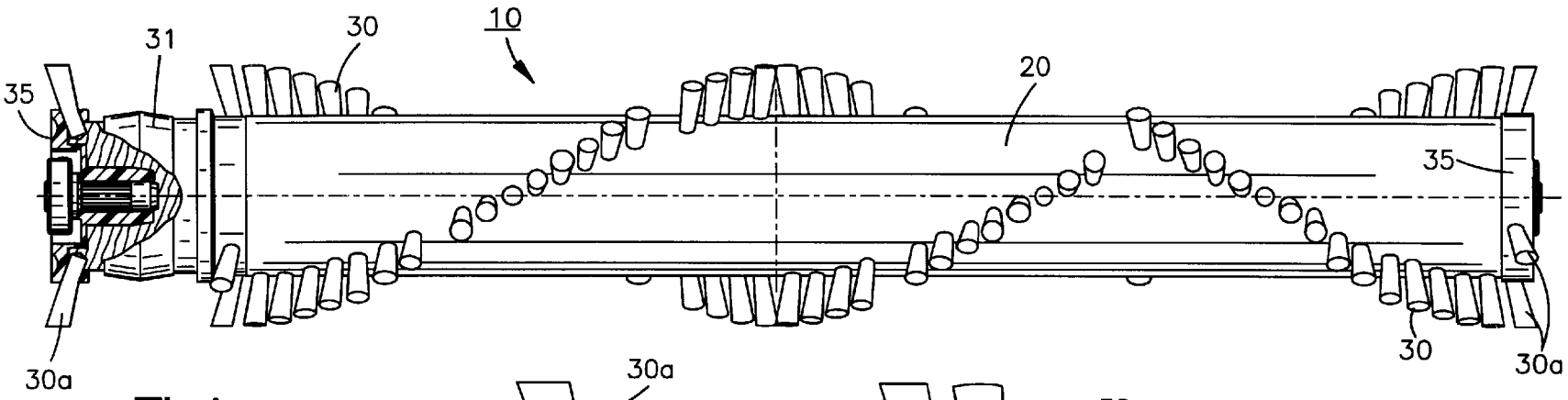
FIG. 1 is a side elevational view of a brushroll according to the invention.

A brushroll 10 according to the present invention is shown in FIG. 1. It consists of a wood spindle or dowel 20 rotatably supported at each end by end assemblies 35. Each end assembly can be mounted in the mouth of the vacuum cleaner nozzle (not shown) to rotatably position the brushroll. In accordance with conventional practice, the spindle 20 includes a pulley belt drive surface 21 near one end, and carries rows of bristle tufts 30 which agitate the carpet to loosen dirt as the brushroll is rotated.

Figure 2:
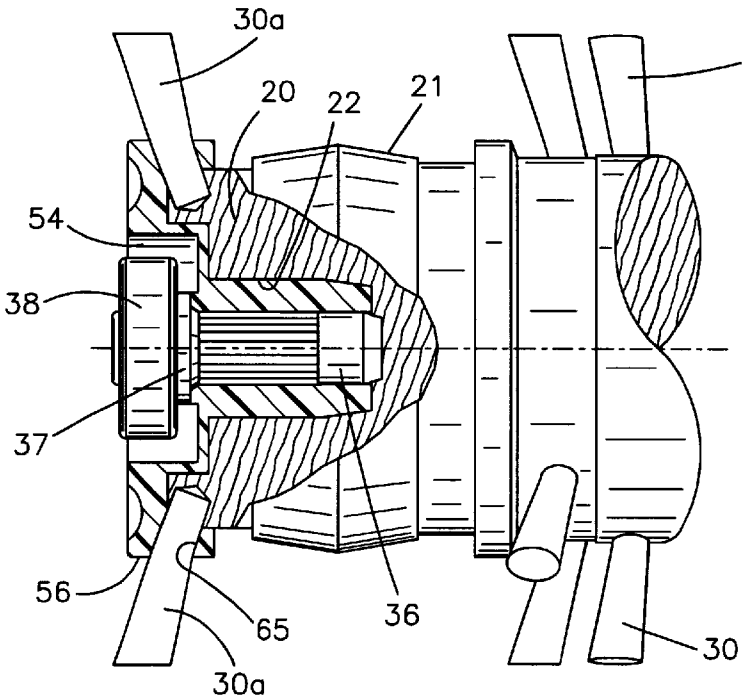
FIG. 2 is a fragmentary end view of the brushroll.
Figure 3:
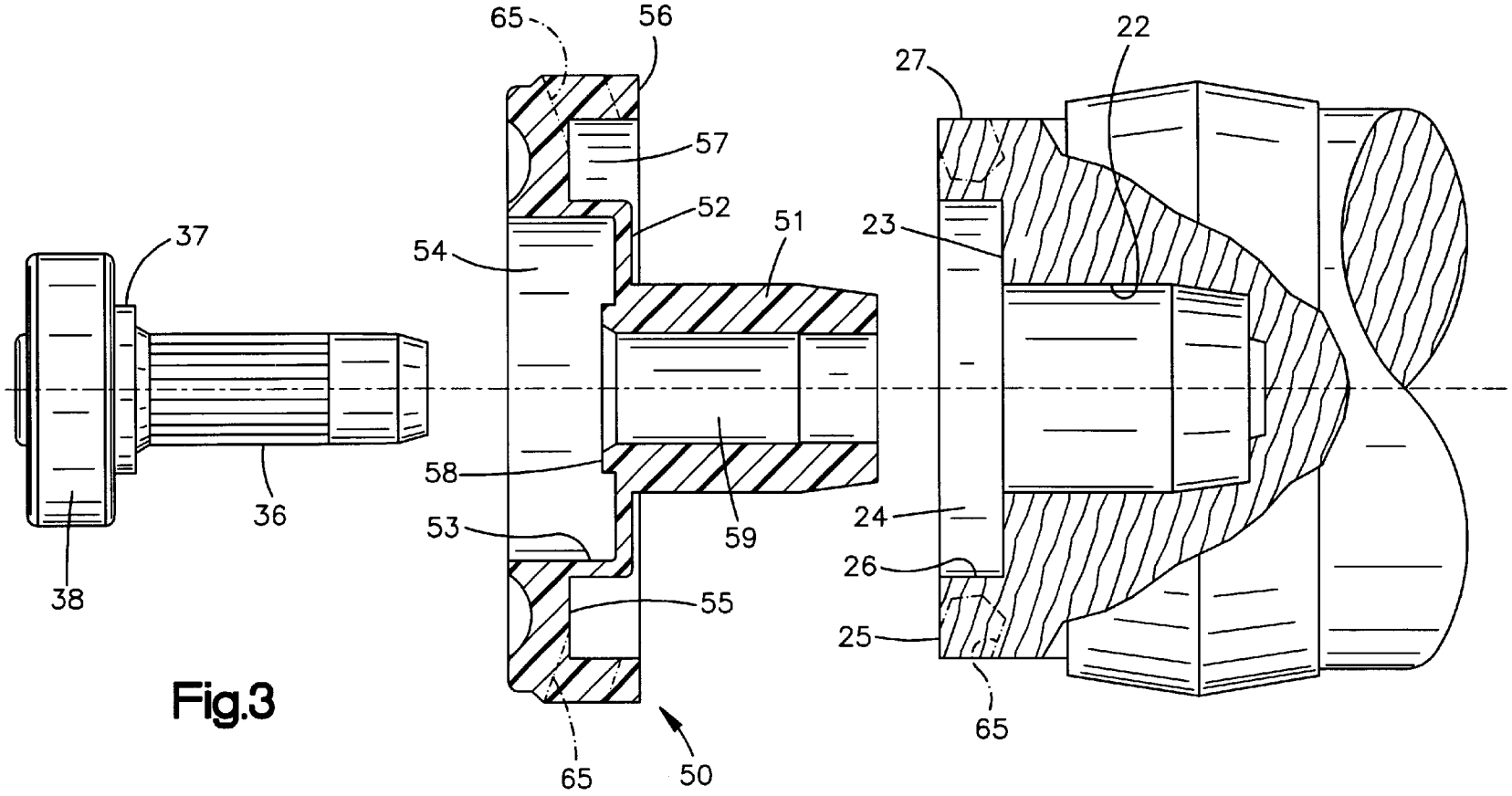
FIG. 3 is an exploded end view of the brushroll.

The ends of the spindle or dowel 20 are similarly formed and only one is shown and described in detail. As illustrated in FIGS. 1–3, an axial hole 22 is drilled in the end of the spindle and opens through the bottom wall 23 of a countersunk mouth 24. An axially extending lip 25 surrounds the mouth 24 and has an inner surface 26 and an outer surface 27.

As more fully disclosed in the above referenced U.S. Pat. No. 5,272,785, each end assembly 35 includes a stub shaft 36, a bearing 37 which has its inner race press fitted on a projecting end of the stub shaft 36, and an end member 38 which has a cavity in which the outer race of the bearing 37 is pressed fitted.

The one-piece plastic ferrule which is an important feature of the present invention is generally designated by reference numeral 50. As shown, the ferrule 50 comprises a central, hollow pin 51, a first radial wall 52 extending outwardly from an end of the pin 51, an axial wall 53 extending from the radial wall 52 to form a mouth 54 at the end of the pin, a second radial wall 55 extending outwardly from the axial wall 53, and a peripheral skirt 56 projecting from the radial wall 55 in a direction opposite to the axial wall 53. The skirt 56 is spaced radially outwardly from the axial wall 53 to form a recess 57 that opens in an axial direction opposite to the ferrule mouth 54. In the illustrated embodiment, a raised seat 58 is formed on the radial wall 52 in the mouth 54 around the inside opening 59 of the pin.

When assembling the brushroll 10, the ferrule pin 51 is pressed into the shaft hole 22 until the radial wall 52 bottoms against the bottom wall 23 of the spindle mouth 24. When the ferrule 50 is pressed into the spindle, the lip 26 is captured in the ferrule recess 57 between the skirt 56 and the wall 53.

Holes are drilled in the brushroll spindle 20 for the bristle tufts 30. As shown in FIGS. 2 and 3, angled holes 65 are drilled through the ferrule skirts 56 into the spindle lips 25. Angled end tufts 30*a* are fixed in the holes 65. The end tufts 30*a* are angled from the perpendicular in a direction axially outwardly of the adjacent end of the spindle 20. The tufts 35*a* are located near the very end of the spindle to provide improved edge cleaning and create a wider cleaning path compared to prior art brushrolls having metal ferrules. The ferrule skirts 56 prevent splitting of the wood when the holes 65 for the tufts 30*a* are drilled. The ferrule skirts 56 also prevent the spindle 20 from expanding because of moisture, and thereby act to maintain a tight fit of the ferrule pins 51 in the end holes 22 of the spindle.

The entire ferrule 50 can be injection molded as a one-piece construction. As compared to metal ferrules, the one-piece plastic construction is a less costly product and reduces scrap parts that can occur when making metal ferrules. An additional advantage is that the one piece construction can be easily inserted into the ends of the spindle in a minimum amount of time.

In a final assembly operation, the stub shafts 36 are pressed into the pins 51 until the end pieces 38 abut the seats 58 in the mouths of the ferrule. Thus assembled, the members 38 are surrounded by the axial walls 53 of the ferrules in order to guard against thread and dirt from entering the bearings.

Many variations and modifications of the invention will be apparent to those skilled in the art in light of the above detailed description. Therefore, to be understood that, within the scope of the appended claims, the invention can be practiced otherwise than as specifically shown and described.

What is claimed is:

1. In a tufted, vacuum cleaner brushroll including a spindle having a longitudinal rotation axis, stub shafts extending from the ends of said spindle, and end members and bearings mounted on said stub shafts, the improvement comprising one-piece plastic ferrules at the ends of said spindle, each ferrule having a hollow pin that receives one of said stub shafts and is fixed in an end of said spindle, a skirt around the end portion of said spindle, and a web between said pin and said skirt, and wherein tufts of said brushroll extend outwardly through said skirt.

2. The improvement as claimed in claim 1, wherein each end of said spindle has a hole in which said hollow pin is fixed, a countersunk mouth, and an outer, axially extending lip around said mouth, and wherein said web has a first radial wall confronting the bottom of said mouth, an axial wall fitted against the inside of said lip, and a second radial wall which connects said skirt and said axial wall, said skirt and axial wall being radially spaced apart to define an annular cavity that receives said lip.

3. The improvement as claimed in claim 2 wherein each of said end members is surrounded by the axial wall of the adjacent ferrule.

4. The improvement as claimed in claim 1 or claim 2 wherein said tufts extending through said skirts are angled axially outwardly beyond the adjacent ends of said spindle in order to provide improved edge cleaning and a wide cleaning path upon rotation of said brushroll.

5. In a vacuum cleaner brushroll including a spindle having a longitudinal rotation axis, tufts extending outwardly from said spindle, and end assemblies for rotatably mounting said brushroll in a vacuum cleaner, the improvement wherein at least one of said end assemblies comprises:

a) a one-piece plastic ferrule having a skirt surrounding an outer circumferential end portion of said spindle, a hollow pin fixed in an end of said spindle, and a web connecting said skirt and pin, b) a stub shaft fixed in said pin and extending therefrom, and c) a bearing assembly on an extending end of said sub shaft.

6. A one-piece plastic ferrule for a vacuum cleaner brushroll comprising a center hollow pin, a first radial wall extending outwardly from said pin, an axial wall projecting in an axially outward direction from said first radial wall to form a mouth at one end of said ferrule, a second radial wall extending outwardly from said axial wall, and a peripheral skirt projecting from said second radial wall, said skirt being spaced radially outwardly from said axial wall to form a recess which opens in an axial direction opposite to said mouth.

7. A ferrule as claimed in claim 6 including an annular seat at the bottom of said mouth around the opening of said hollow pin.

8. In a vacuum cleaner brushroll including a spindle having a longitudinal axis, tufts extending outwardly from said spindle, and end assemblies for rotatably mounting said brushroll in a vacuum cleaner, the improvement wherein at least one of said end assemblies comprises:

a) a one-piece plastic ferrule having a skirt around an outer end portion of said spindle, a hollow pin fixed in an end of said spindle, and a web connecting said skirt and pin, b) a stub shaft fixed in said pin and extending therefrom, c) a bearing assembly on an extending end of said stub shaft, and d) said tufts of said brushroll extending outwardly through said skirt and angling beyond the adjacent end of said spindle to provide improved, wide angle edge cleaning.

9. The improvement as claimed in claim 8 wherein said outer end of said spindle has an axially extending lip, and wherein said web includes a wall spaced radially inwardly of said skirt, said lip being fitted between said skirt and said wall.

* * * * *